US007744343B2

(12) United States Patent
Burdgick et al.

(10) Patent No.: US 7,744,343 B2
(45) Date of Patent: Jun. 29, 2010

(54) METHOD AND APPARATUS FOR CONTROLLING THE OPERATION OF A STEAM TURBINE

(75) Inventors: Steven Sebastian Burdgick, Guilderland, NY (US); Boris Ivanovitch Frolov, Kharkov (UA)

(73) Assignee: General Electric Company, Schenectady, NY (US)

( * ) Notice: Subject to any disclaimer, the term of this patent is extended or adjusted under 35 U.S.C. 154(b) by 923 days.

(21) Appl. No.: 11/534,170

(22) Filed: Sep. 21, 2006

(65) Prior Publication Data

US 2008/0075578 A1 Mar. 27, 2008

(51) Int. Cl.
*F01D 25/32* (2006.01)

(52) U.S. Cl. ..... 415/169.4; 415/144

(58) Field of Classification Search ..... 415/121.2, 415/144, 145, 168.1, 168.2, 168.4, 169.1, 415/169.2, 169.4, 169.3
See application file for complete search history.

(56) References Cited

U.S. PATENT DOCUMENTS 3,966,355 A * 6/1976 Pierpoline ..... 415/144
5,494,405 A 2/1996 Gray et al.
5,573,370 A 11/1996 Gray et al.
5,984,628 A 11/1999 Gray et al.
6,971,844 B2 12/2005 Burdgick

FOREIGN PATENT DOCUMENTS

JP 60008402 A * 1/1985

* cited by examiner

*Primary Examiner*—Edward Look
*Assistant Examiner*—Dwayne J White
(74) *Attorney, Agent, or Firm*—Armstrong Teasdale LLP

(57) ABSTRACT

A steam turbine includes, in one exemplary embodiment, a rotor and a plurality of bucket stages coupled to the rotor with each bucket stage including a plurality of circumferentially spaced buckets coupled to the rotor. The steam turbine also includes a diaphragm assembly surrounding the rotor and the bucket stages, and an outer casing disposed about the rotor and diaphragm assembly. The diaphragm assembly includes a plurality of nozzle stages located between the bucket stages, a circumferentially extending groove, with the groove located upstream of one of the bucket stages and between that bucket stage and an adjacent nozzle stage, a circumferentially extending extraction chamber, and at least one first bore extending from the groove to the extraction chamber. The diaphragm assembly also includes at least one second bore extending from the extraction chamber through an outer surface of the diaphragm assembly.

20 Claims, 6 Drawing Sheets

METHOD AND APPARATUS FOR CONTROLLING THE OPERATION OF A STEAM TURBINE

BACKGROUND OF THE INVENTION

This invention relates generally to steam turbines and more generally to methods and apparatus for low flow bucket tip cooling and moisture removal.

In known steam turbines low flow conditions (low VAN) sometime occur at startup and during high back pressure operation. The flow structure in the last stage of a steam turbine (L-0 stage) changes significantly during low VAN operation. This change is due to centrifugal forces acting on the buckets which can send steam upward, and can create tip and root recirculation zones along with the main steam flow. In the bucket root zone the flow is in a backwards direction, bringing cold and wet steam from the condenser into the steam path. In the tip (outer flowpath) steam recirculation provides significant heating impact on the bucket tip section due to "windage". During low flow, high speed, operation, the flow near the bucket tip can become trapped and subsequently the steam is heated due to the bucket tip doing work on the steam that is trapped. This "windage" heating primarily takes place under startup low VAN conditions.

When low VAN operation is the result of high back pressure, the flow in this tip zone can also be subject to flow instability (unsteadiness) and pressure pulsation, which result in the L-0 bucket dynamic stresses increasing. At steady state operation, moisture can accumulate at the L-0 nozzle outer sidewall. Removal of this moisture can reduce last stage bucket (LSB) erosion.

The low VAN conditions described above can have a detrimental effect on the last stage bucket. The heating of the bucket tip area can reduce bucket life and reliability. It can also reduce the ability to use a hybrid bucket construction (polymer filler in the outer bucket area). Also, the instability from the low VAN conditions can cause pressure pulsations that could affect the bucket reliability. Additionally, excess moisture in the last stages sometimes accumulates on the outer sidewall, among other locations, of the last stage nozzle which can cause erosion of the nozzle.

BRIEF DESCRIPTION OF THE INVENTION

In one aspect, a steam turbine is provided that includes a rotor and a plurality of bucket stages coupled to the rotor. Each bucket stage includes a plurality of circumferentially spaced buckets coupled to the rotor, with each bucket having a base portion and a tip portion. The steam turbine also includes a diaphragm assembly surrounding the rotor and the bucket stages, and an outer casing disposed about the rotor and diaphragm assembly. The diaphragm assembly includes a plurality of nozzle stages located between the bucket stages, a circumferentially extending groove, with the groove located upstream of one of the bucket stages and between that bucket stage and an adjacent nozzle stage, a circumferentially extending extraction chamber, and at least one first bore extending from the groove to the extraction chamber. The at least one first bore provides fluid communication between the groove and the extraction chamber. The diaphragm assembly also includes at least one second bore extending from the extraction chamber through an outer surface of the diaphragm assembly; with the at least one second bore providing fluid communication between the extraction chamber and an area between the outer surface of the diaphragm assembly and the outer casing.

In another aspect, a diaphragm assembly for a steam turbine is provided. The steam turbine includes a rotor and a plurality of bucket stages coupled to the rotor. The diaphragm assembly includes a plurality of nozzle stages configured to be positioned between the bucket stages, a circumferentially extending groove, with the groove located between one bucket stage and a nozzle stage that is positioned adjacent the bucket stage, a circumferentially extending extraction chamber, and at least one first bore extending from the groove to the extraction chamber. The at least one first bore provides fluid communication between the groove and the extraction chamber. The diaphragm assembly also includes at least one second bore extending from the extraction chamber through an outer surface of the diaphragm assembly. The at least one second bore provides fluid communication between the extraction chamber and an area outside of said diaphragm assembly.

In another aspect, a method of controlling the operation of a steam turbine is provided. The steam turbine includes a rotor, a plurality of bucket stages coupled to the rotor, and an outer casing disposed about the rotor. Each bucket stage includes a plurality of circumferentially spaced buckets coupled to the rotor, with each bucket having a base portion and a tip portion. The method includes providing a diaphragm assembly to surround the rotor and bucket stages. The diaphragm assembly includes a plurality of nozzle stages located between the bucket stages, a circumferentially extending groove, with the groove located upstream of one of the bucket stages and between that bucket stage and an adjacent nozzle stage, a circumferentially extending extraction chamber, and at least one first bore extending from the groove to the extraction chamber. The at least one first bore provides fluid communication between the groove and the extraction chamber. The diaphragm assembly also includes at least one second bore extending from the extraction chamber through an outer surface of the diaphragm assembly; with the at least one second bore providing fluid communication between the extraction chamber and an area between the outer surface of the diaphragm assembly and the outer casing.

DETAILED DESCRIPTION OF THE INVENTION

A diaphragm for a steam turbine having a circumferentially extending groove, an extraction chamber, at least one bore connecting the groove with the extraction chamber, and at least one bore connecting the extraction chamber to an area between the diaphragm and the outer casing of the turbine is described below in detail. The diaphragm permits cold steam to be delivered into the tip recirculation zone of the last stage bucket to reduce "windage" heating conditions during startup operation. Also, during high back pressure operation, the diaphragm permits the steam in the outboard area to be evacuated from the tip recirculation zone to reduce flow instability near the tip to reduce last stage bucket dynamic stresses. Further, during steady state operation, the diaphragm permits moisture removal from the last stage bucket area to reduce erosion of the last stage bucket.

Figure 1:
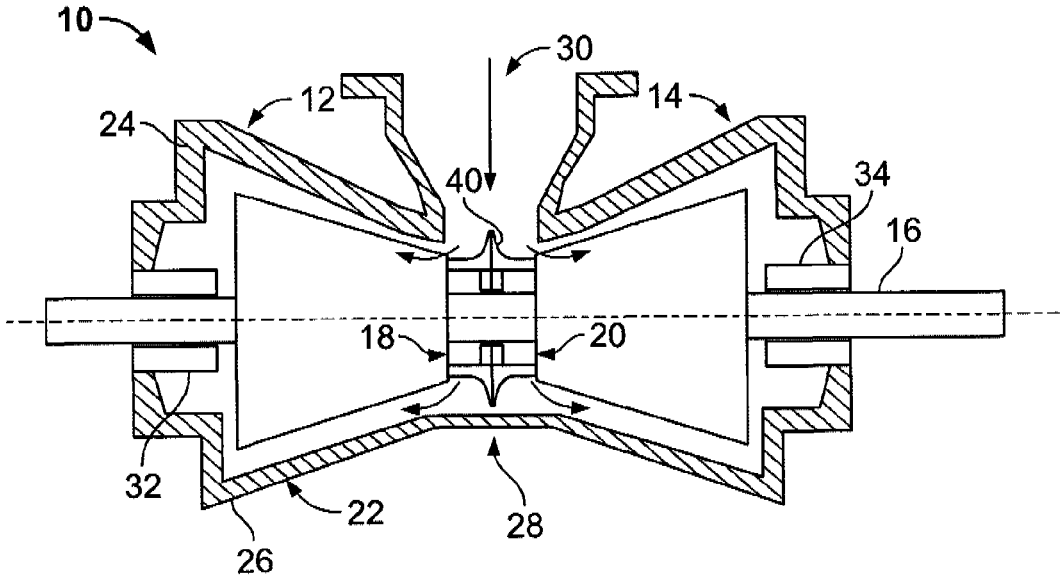
FIG. 1 is a cross-sectional schematic illustration of an exemplary opposed-flow steam turbine.

Referring to the drawings, FIG. 1 is a schematic illustration of an exemplary opposed-flow, low-pressure (LP) steam turbine 10. Turbine 10 includes first and second low pressure sections 12 and 14. As is known in the art, each turbine section 12 and 14 includes a plurality of stages of nozzles and buckets (not shown in FIG. 1). A rotor shaft 16 extends through sections 12 and 14. Each LP section 12 and 14 includes an input nozzle 18 and 20 respectively. A single outer shell or casing 22 is divided along a horizontal plane and axially into upper and lower half sections 24 and 26, respectively, and spans both LP sections 12 and 14. A central section 28 of shell 22 includes a low pressure steam inlet 30. Within outer shell or casing 22, LP sections 12 and 14 are arranged in a single bearing span supported by journal bearings 32 and 34. A flow splitter 40 extends between first and second turbine sections 12 and 14.

Figure 2:
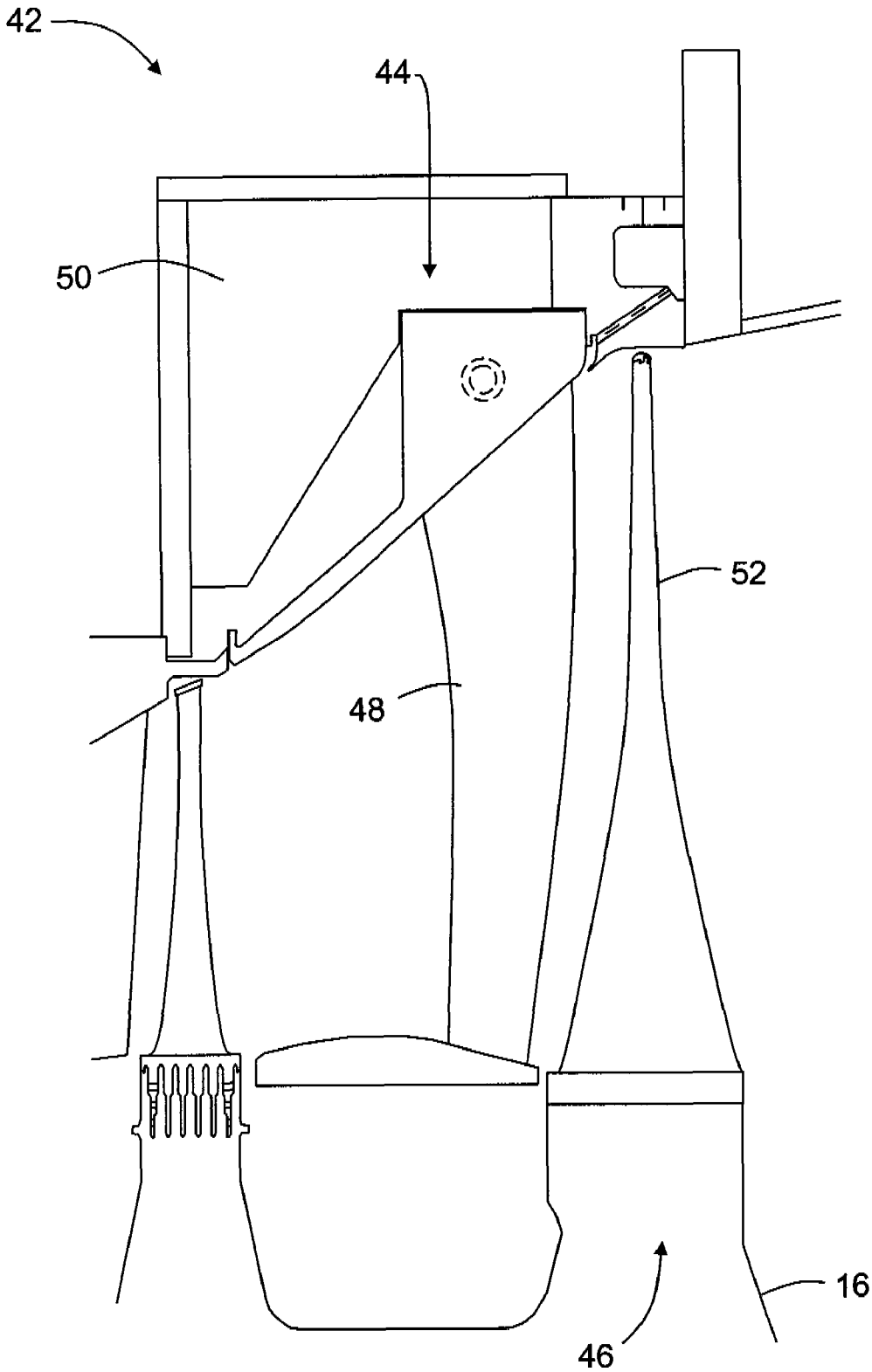
FIG. 2 is a cross-sectional schematic illustration of the last stage of the steam turbine shown in FIG. 1 in accordance with an embodiment of the present invention.

FIG. 2 is a cross-sectional schematic illustration of a last stage 42 of steam turbine 10 in accordance with an exemplary embodiment of the present invention. Stage 42 includes a stationary nozzle stage 44 and an adjacent rotating bucket stage 46. Nozzle stage 44 includes a plurality of circumferentially spaced nozzles 48 attached to a diaphragm assembly 50. Bucket stage 46 includes a plurality of circumferentially spaced buckets 52 coupled to rotor shaft 16. Diaphragm assembly 50 surrounds nozzle stages 44 and bucket stages 46.

Figure 3:
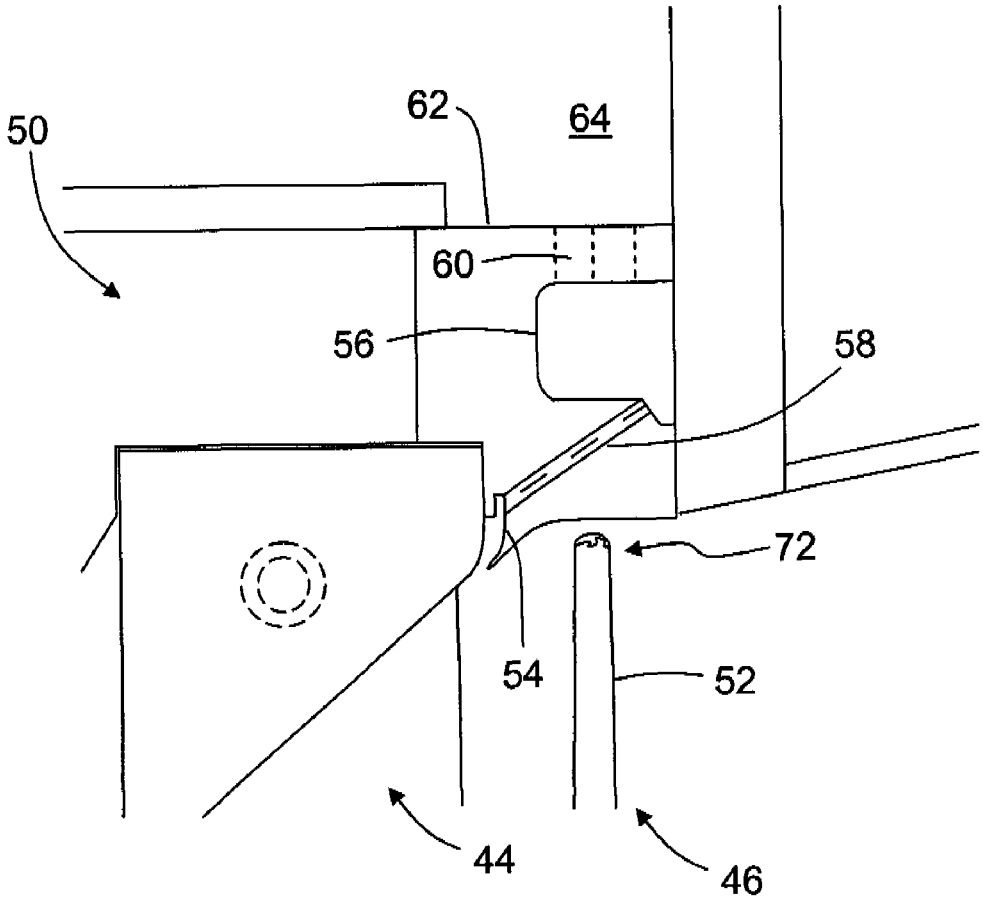
FIG. 3 is an enlarged schematic illustration of the diaphragm assembly shown in FIG. 2.

Referring also to FIG. 3, diaphragm assembly 50 includes a circumferentially extending groove 54 located upstream of bucket stage 46 and between bucket stage 46 and adjacent nozzle stage 44, and a circumferentially extending extraction chamber 56. At least one first bore 58 extends from groove 54 to extraction chamber 56. First bore 58 provides fluid communication between groove 54 and extraction chamber 56. At least one second bore 60 extends from extraction chamber 56 through an outer surface 62 of diaphragm assembly 50. Second bore 60 provides fluid communication between extraction chamber 56 and an area 64 between an outer surface 66 of diaphragm assembly 50 and outer casing 22 (shown in FIG. 1). In this exemplary embodiment, groove 54 has a scoop shaped cross section.

Figure 4:
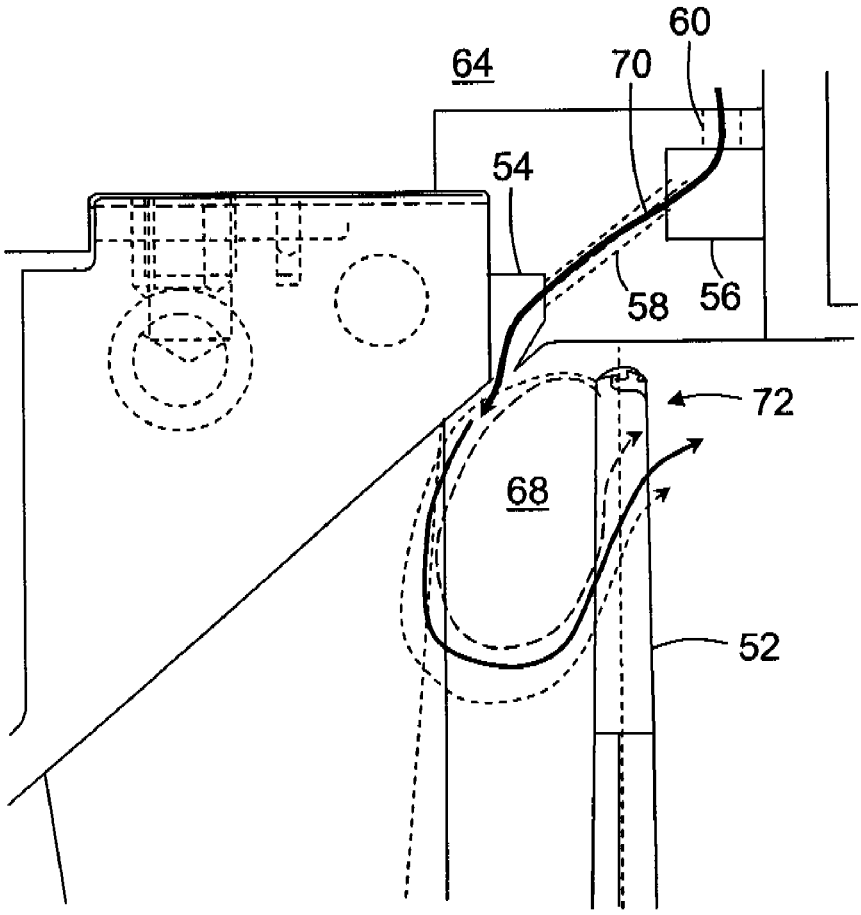
FIG. 4 is a cross-sectional schematic illustration of the last stage shown in FIG. 3 showing a cooling steam injection flow path.

Groove 54 in combination with extraction chamber 56 and first and second bores 58 and 60 facilitates the delivery of cold steam into a tip recirculation zone 68 of last stage bucket 52 to reduce "windage" heating conditions during startup operation. FIG. 4 illustrates a cold steam flow 70 from area 64 between diaphragm assembly 50 and outer casing 22 into tip recirculation zone 68 to reduce "windage" heating. Also, during high back pressure operation, groove 54 in combination with extraction chamber 56 and first and second bores 58 and 60 facilitates evacuation of the steam from tip recirculation zone 68 to reduce flow instability near the tip 72 of bucket 52 which can reduce last stage bucket dynamic stresses. Further, during steady state turbine operation, groove 54 in combination with extraction chamber 56 and first and second bores 58 and 60 facilitates moisture removal from the last stage bucket area to reduce erosion of the last stage buckets 52. It is believed that the scoop shaped cross section of groove 54 enhances moisture removal from diaphragm assembly 50.

Figure 5:
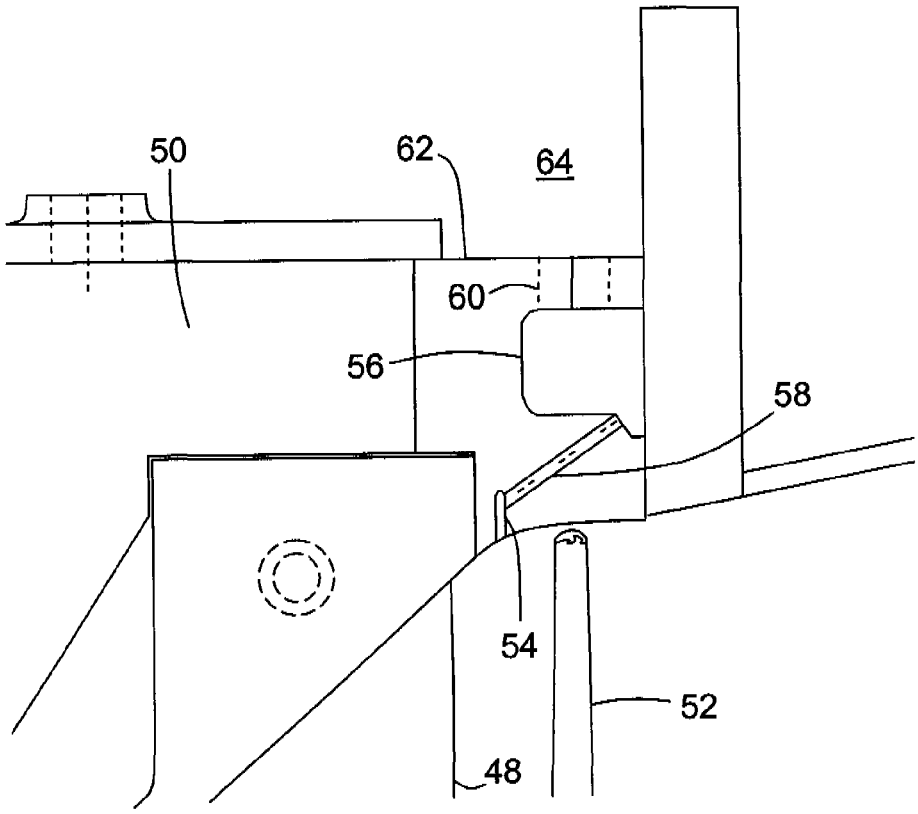
FIG. 5 is a cross-sectional schematic illustration of the last stage of the steam turbine shown in FIG. 1 in accordance with another embodiment of the present invention.

In another exemplary embodiment, shown in FIG. 5, groove 54 has the shape of a slot extending circumferentially around diaphragm assembly 50. As described above, at least one first bore 58 extends from slot shaped groove 54 to extraction chamber 56, and at least one second bore 60 extends from extraction chamber 56 through outer surface 62 of diaphragm assembly 50.

Figure 6:
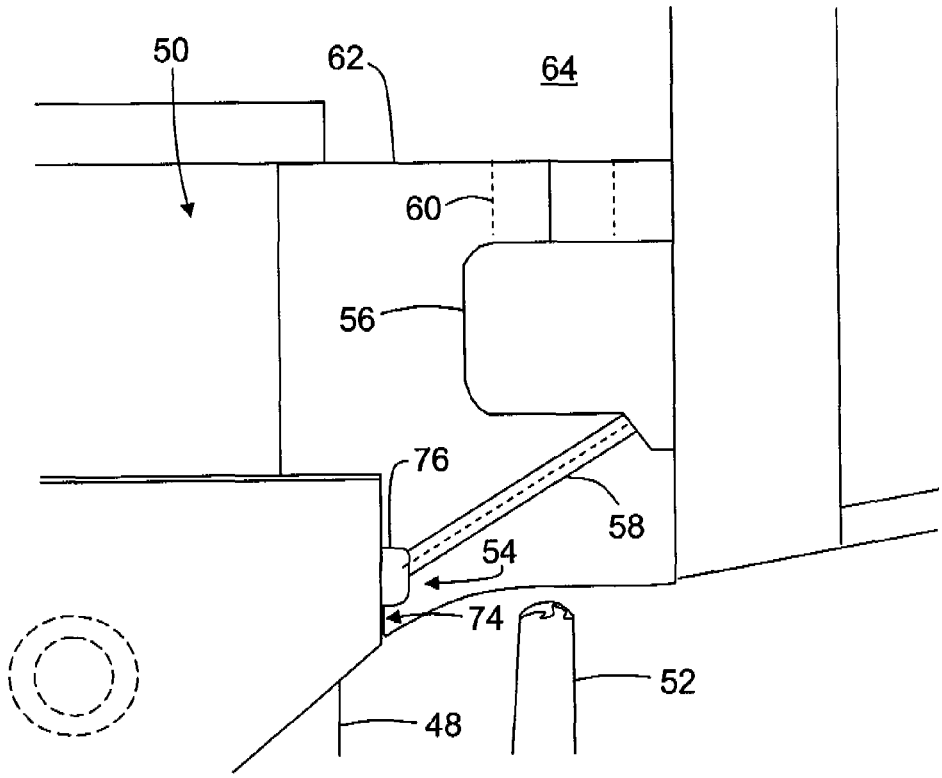
FIG. 6 is a cross-sectional schematic illustration of the last stage of the steam turbine shown in FIG. 1 in accordance with another embodiment of the present invention.

In another exemplary embodiment, shown in FIG. 6, groove 54 includes a slot portion 74 connected to an outer pocket 76 with the width of outer pocket 76 larger than the width of slot portion 74. First bores 58 extend from outer pocket 76 to extraction chamber 56, and second bores 60 extend from extraction chamber 56 through outer surface 62 of diaphragm assembly 50.

In operation of turbine 10 during low VAN start-up conditions, "cold" steam flows from area 64 between diaphragm assembly 50 and outer casing 22 through second bores 60 into extraction chamber 56, then through first bores 58 into groove 54, and then into tip recirculation zone 68. The "cold" steam reduces "windage" heating conditions during low VAN start-up conditions.

During high back pressure operation of turbine 10, steam from the main steam flow is vented to the condenser to relieve the back pressure conditions. The steam flows into groove 54 and through first bores 58 into extraction chamber 56, then through second bores 60 into area 64 between diaphragm assembly 50 and outer casing 22 where the vented steam is directed to the condenser.

During steady state operating conditions, accumulated moisture is vented from last stage 42 to the condenser to remove the accumulated moisture from last stage 42. The moisture flows into groove 54 and through first bores 58 into extraction chamber 56, then through second bores 60 into area 64 between diaphragm assembly 50 and outer casing 22 where the vented moisture is directed to the condenser.

While the invention has been described in terms of various specific embodiments, those skilled in the art will recognize that the invention can be practiced with modification within the spirit and scope of the claims.

What is claimed is:

1. A steam turbine comprising:

a rotor;

a plurality of bucket stages coupled to said rotor, each said bucket stage comprising a plurality of circumferentially spaced buckets coupled to said rotor, each said bucket comprising a base portion and a tip portion;

a diaphragm assembly surrounding said rotor and said bucket stages; and an outer casing disposed about said rotor and diaphragm assembly;

said diaphragm assembly comprising:

a plurality of nozzle stages located between said bucket stages;

a circumferentially extending groove, said groove located upstream from one of said bucket stages and between said bucket stage and an adjacent nozzle stage positioned upstream from said bucket stage;

a circumferentially extending extraction chamber;

at least one first bore extending from said groove to said extraction chamber, said at least one first bore providing bi-directional fluid communication between said groove and said extraction chamber; and at least one second bore extending from said extraction chamber through an outer surface of said diaphragm assembly; said at least one second bore providing bi-directional fluid communication between said extraction chamber and an area between said outer surface of said diaphragm assembly and said outer casing.

2. A steam turbine in accordance with claim 1 wherein said groove comprises a slot.

3. A steam turbine in accordance with claim 1 wherein said groove comprises a substantially scoop shape.

4. A steam turbine in accordance with claim 1 wherein said groove comprises a slot connected to an outer pocket, said at least one first bore extending from said outer pocket to said extraction chamber.

5. A steam turbine in accordance with claim 1 wherein said groove is located upstream of a last bucket stage.

6. A steam turbine in accordance with claim 1 wherein the area between the outer surface of the diaphragm assembly is in flow communication with a condenser.

7. A diaphragm assembly for a steam turbine, the steam turbine including a rotor and a plurality of bucket stages coupled to the rotor, said diaphragm assembly comprising:

a plurality of nozzle stages configured to be positioned between the bucket stages;

a circumferentially extending groove, said groove located upstream from one bucket stage and between the one bucket stage and a nozzle stage that is positioned upstream from the bucket stage and adjacent to the one bucket stage;

a circumferentially extending extraction chamber;

at least one first bore extending from said groove to said extraction chamber, said at least one first bore providing bi-directional fluid communication between said groove and said extraction chamber; and at least one second bore extending from said extraction chamber through an outer surface of said diaphragm assembly; said at least one second bore providing bi-directional fluid communication between said extraction chamber and an area outside of said diaphragm assembly.

8. A diaphragm assembly in accordance with claim 7 wherein said groove comprises a slot.

9. A diaphragm assembly in accordance with claim 7 wherein said groove comprises a substantially scoop shape.

10. A diaphragm assembly in accordance with claim 7 wherein said groove comprises a slot connected to an outer pocket, said at least one first bore extending from said outer pocket to said extraction chamber.

11. A diaphragm assembly in accordance with claim 7 wherein said groove is located upstream of a last bucket stage.

12. A method of controlling the operation of a steam turbine, the steam turbine comprising a rotor, a plurality of bucket stages coupled to the rotor, and an outer casing disposed about the rotor, each bucket stage comprising a plurality of circumferentially spaced buckets coupled to the rotor, each bucket comprising a base portion and a tip portion; said method comprising:

providing a diaphragm assembly to surround the rotor and bucket stages, the diaphragm assembly comprising:

a plurality of nozzle stages located between the bucket stages;

a circumferentially extending groove, the groove located upstream from one of the bucket stages and between that bucket stage and an adjacent nozzle stage positioned upstream from the bucket stage;

a circumferentially extending extraction chamber;

at least one first bore extending from the groove to the extraction chamber, the at least one first bore providing bi-directional fluid communication between the groove and the extraction chamber; and at least one second bore extending from the extraction chamber through an outer surface of the diaphragm assembly; the at least one second bore providing bi-directional fluid communication between the extraction chamber and an area between the outer surface of the diaphragm assembly and the outer casing.

13. A method in accordance with claim 12 further comprising delivering external cooling steam to tip portion of the buckets of a bucket stage by passing cooling steam from the area between the outer surface of the diaphragm and the outer casing through the at least one second bore, through the extraction chamber, through the at least one first bore, through the groove and into the main steam flow cavity to cool the bucket stage during low steam flow operating conditions.

14. A method in accordance with claim 12 further comprising removing moisture through the groove, through the at least one first bore, through the extraction chamber, through the at least one second bore and into the area between the outer surface of the diaphragm assembly and the outer casing during steady state operating conditions.

15. A method in accordance with claim 14 wherein the area between the outer surface of the diaphragm assembly is in flow communication with a condenser.

16. A method in accordance with claim 12 further comprising removing steam through the groove, through the at least one first bore, through the extraction chamber, through the at least one second bore and into the area between the outer surface of the diaphragm assembly and the outer casing during high back pressure operating conditions.

17. A method in accordance with claim 12 wherein the groove comprises a slot.

18. A method in accordance with claim 12 wherein the groove comprises a substantially scoop shape.

19. A method in accordance with claim 12 wherein the groove comprises a slot connected to an outer pocket, the at least one first bore extending from the outer pocket to the extraction chamber.

20. A method in accordance with claim 12 wherein the groove is located upstream of a last bucket stage.

* * * * *